United States Patent [19]

Bolen, Jr. et al.

[11] Patent Number: 4,993,606

[45] Date of Patent: Feb. 19, 1991

[54] DISPENSING CLOSURE

[76] Inventors: Robert J. Bolen, Jr., 10 Gwynn Ct., Closter, N.J. 07624; Thomas R. Bolen, 64 Wheeler Ave., Westwood, N.J. 07675

[21] Appl. No.: 493,828

[22] Filed: Mar. 15, 1990

Related U.S. Application Data

[63] Continuation of Ser. No. 214,676, Jul. 1, 1988, abandoned.

[51] Int. Cl.[5] ..... B65D 47/08

[52] U.S. Cl. ..... 222/546; 215/235; 220/338; 222/556

[58] Field of Search ..... 222/498, 517, 534, 546, 222/556; 215/235, 237; 220/335, 338

[56] References Cited

U.S. PATENT DOCUMENTS

| | | | |
|---|---|---|---|
| 2,690,861 | 10/1954 | Tupper | 222/546 |
| 2,851,203 | 9/1958 | Nowak | 222/543 |
| 3,124,281 | 3/1964 | Stull | 222/543 X |
| 3,204,829 | 9/1965 | Song | 222/546 X |
| 3,240,405 | 3/1966 | Abbott | 222/546 X |
| 3,575,324 | 4/1971 | Hazard | 222/556 X |
| 3,718,238 | 2/1973 | Hazard et al. | 222/556 X |
| 3,877,598 | 4/1975 | Hazard | 222/546 X |
| 4,022,352 | 5/1977 | Pehr | 222/546 X |
| 4,047,495 | 9/1977 | O'Brien | 215/224 |
| 4,158,902 | 6/1979 | Chernack et al. | 222/498 X |
| 4,220,248 | 9/1980 | Wilson et al. | 222/517 X |
| 4,244,495 | 1/1981 | Lorscheid et al. | 222/546 X |
| 4,261,486 | 4/1981 | Bush et al. | 222/563 X |
| 4,281,778 | 8/1981 | Stull | 222/546 X |
| 4,358,032 | 11/1982 | Libit | 222/498 |
| 4,377,247 | 3/1983 | Hazard et al. | 222/543 X |
| 4,377,248 | 3/1983 | Stull | 222/543 |
| 4,402,435 | 9/1983 | Libit | 222/556 |
| 4,463,882 | 8/1984 | Hammett | 222/546 X |
| 4,513,888 | 4/1985 | Curry | 222/498 X |
| 4,625,898 | 12/1986 | Hazard | 222/546 X |
| 4,632,266 | 12/1986 | Osswald | 222/556 X |
| 4,666,068 | 5/1987 | Bush | 222/556 X |
| 4,669,622 | 6/1987 | Bennett | 222/556 X |
| 4,699,301 | 10/1987 | Blake | 222/546 |
| 4,700,858 | 10/1987 | Bennett | 220/335 X |

*Primary Examiner*—Kevin P. Shaver

*Attorney, Agent, or Firm*—Davis Hoxie Faithfull & Hapgood

[57] ABSTRACT

A two piece dispensing closure for a container having an internally threaded base with a dispensing orifice in the front section and an elevated rear land that has a pivot recess adapted to receive a separate lid that rotates at least 90° from the closed position. The front section of the lid is generally circular with a pivot post at its rear, and when closed the upper surfaces of the lid and base are coplanar.

39 Claims, 2 Drawing Sheets

DISPENSING CLOSURE

"This is a continuation of copending application(s) Ser. No. 07/214,676 filed on July 1, 1988 now abandoned."

BACKGROUND OF THE INVENTION

The present invention relates generally to a dispensing closure for containers and more particularly to a two piece dispensing closure, wherein a hinged lid is moved from a base of the closure to uncover an orifice through which the container contents are dispensed. This type of closure is made from molded plastic and used extensively in dispensing food products, such as salad dressings, and for personal care and household products.

The typical dispensing closure for a container comprises a generally circular base with a dispensing orifice in the front section of the upper surface and an annular skirt depending downwardly from the upper surface that is adapted to engage and secure the base to the container, usually by means of internal threads that are screwed onto the neck of the container. A lid having a plug on its underside for sealing the dispensing orifice is adapted to be pivotally moved with respect to the base to be opened and closed by the pressure of the finger or thumb.

In many instances the base and lid of the closure are molded as a single unit, the lid being connected to the base by a flexible hinge, which is known in the industry as a "living hinge". A disadvantage of the "living hinge" is that the hinge portion of the closure has a tendency to crack, and eventually break, separating the lid from the base. Also, when the lid is rotated from the open position, it reaches a point from which it tends to snap rapidly to the closed position, and can splash liquid product, or even catapult one or more drops toward the user's face or clothing, thus presenting some danger if the product is an irritant.

Moreover, in the "living hinge" design, at least a portion of the hinge necessarily extends beyond the circumferential periphery of the closure of the rear of the base and creates problems during the assembly line filling of the container in that such an eccentric shape is subject to bumping and breakage, and can interfere with the highly automated equipment used during assembly of the closure and container of the product to be marketed.

The "living hinge" design has been replaced to some extent by a dispensing closure design where the base has a notch located at the approximate center of top, and a relatively narrow rectangular channel extends from the notch to the front edge of the base with a dispensing orifice positioned in the channel proximate the front edge. A lid having a generally flat upper surface which terminates in a downwardly depending flange and indented end pieces is adapted to be received in a snap-fit into the notch, and when rotated to the closed position, lies entirely within the channel. The underside of the lid has an annular plug which mates with, and seals the orifice. The lid is maintained in the open position by means of an interference fit between the bottom edge of the flange and lugs located at the forward edge of the bottom of the notch where it intersects the rear of the channel. The lid is maintained in the notch in the open position by contact between a groove in the leading edge of the flange and a tab protruding upwardly from the intersection of the front wall and bottom of the notch.

Another type of dispensing closure has been developed where the base and a dispensing nozzle, or spout, comprise two separate components that are interconnected through a modified ball and socket joint, or protruding pin or post from one component mating with a corresponding recess in the other component to form a pin/recess hinge structure between the two components. In one form of the pin/recess hinge design, the outer surface of the base of the closure has a notch formed therein, said notch being shaped to receive one end of a hollow dispensing type nozzle of the lid which has a passageway for the liquid product. In the fully open position the nozzle communicates with the inside of the container by means of an orifice through the base located in the bottom of the notch. The nozzle end portion mates in a modified ball and socket configuration when press fit into the notch in the base. This latter ball and socket hinge design further relies upon a keyslot configuration in the notch of the bas and the portion of the dispensing nozzle to be disposed within the notch, respectively, to limit the open position of the dispensing nozzle type lid, as well as interfering projections on the forward face of the notch and on the portion of the nozzle disposed within the notch to maintain the nozzle in an open position during the dispensing of product from the container. The interference fit yields to finger pressure to move the nozzle through the interference fit and return the lid to a closed position on the base of the closure.

In another form of two piece dispensing closure, the lid is circular and the end of the lid opposite the orifice contains two slots which mate with two posts extending upwardly from the surface of the base of the circular closure at its periphery. In this slot and post design, the posts are flexible and exposed, and are therefore subject to damage during handling of the closure or container. In addition, the lid is insecurely held in place, is subject to twisting and lateral movement, and is easily pulled from the posts when the lid is in the open position.

The closure of this invention is an improvement over these prior art closures.

It is a principal object of the invention to provide a two piece dispensing closure which has a hinge structure that provides a smooth peripheral symmetry, a planar top, and one which is less susceptible to damage than existing dispensing closures.

A further object to the present invention is the provision of a two piece dispensing closure which is simple in construction, pleasing in appearance and capable of a long, useful service life.

It is another object of the invention to provide a container closure in which the lid will remain in the open position and resist closing even when the container is inverted and vigorously shaken.

Another object of the invention is to provide a dispensing closure with a lid that remains in a stable working position without cracking or separating from the base.

It is yet another object of this invention to provide a closure in which there is an interference fit between the lid and the base as the lid is rotated to its fully open position, so that at least a perceptible finger pressure is required to move the lid to the closed position.

It is also a object of this invention to provide a dispensing closure which will permit the contents of the container to be secured from tampering after filling and which will have a smooth underside free from crevices and openings which may become contaminated.

With these and other objects in view, as will be apparent to those skilled in the art, the invention resides in the combination of parts set forth in the specification and covered by the claims appended hereto.

SUMMARY OF THE INVENTION

In its broadest aspect, the invention comprises a two piece dispensing closure for a container comprising a generally circular base with a dispensing orifice in the front section of the upper surface and an annular skirt depending downwardly from the upper surface which is adapted to engage and secure the base to the container, and a separate lid having a plug on its underside for sealing the dispensing orifice and adapted to be pivotally assembled to the base to open and seal the dispensing orifice, and the improvements comprising an elevated rear land section extending upwardly from and across the surface of the base opposite the dispensing orifice that is joined to the base by a transverse abutting wall, and a pivot recess in the elevated rear land adapted to pivotally receive the lid. The improved lid of the invention comprises a generally circular front section and a rearwardly extending, downwardly depending pivot post adapted to fictionally engage the pivot recess in the elevated rear section. The generally circular front section of the lid terminates along a chord, or transverse line, proximate the upper edge of the abutting wall, and the upper surfaces of the closed lid and the elevated rear section of the base are co-planar, i.e., the closed lid is flush with the elevated rear land. The pivot recess in the base is configured with an outwardly inclined rear wall, (i.e., the wall which is closest to the periphery of the closure), and an opposing front wall which is configured to permit free opening of the lid, i.e., without frictional interference between the front wall of the recess and the pivot post of the lid.

In one preferred embodiment, the pivot recess in the elevated rear land portion of the base and the pivot post of the lid are configured to provide an interference fit between the rear wall of the recess and the pivot post of the lid as the lid is rotated to the open position.

Further, the plug on the lid has means for securing the lid to the dispensing orifice in the base when it is pressed firmly into the closed position.

The closure can be molded from any of a variety of resilient polymeric materials well known to those in the art, including polypropylene, polyethylene and polyvinylchloride and copolymers and blends of said polymers.

BRIEF DESCRIPTION OF THE DRAWINGS

The invention will be best understood by reference to one of its structural forms, as illustrated by the accompanying drawings, in which.

DESCRIPTION OF THE PREFERRED EMBODIMENT

Figure 1:
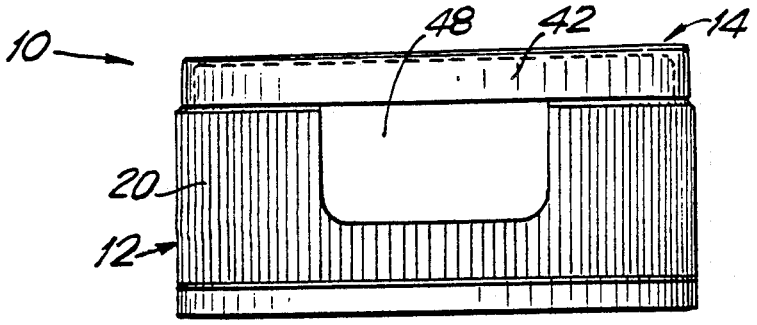
FIG. 1 is a front elevational view of a two piece dispensing closure embodying the features of the present invention.
Figure 2:
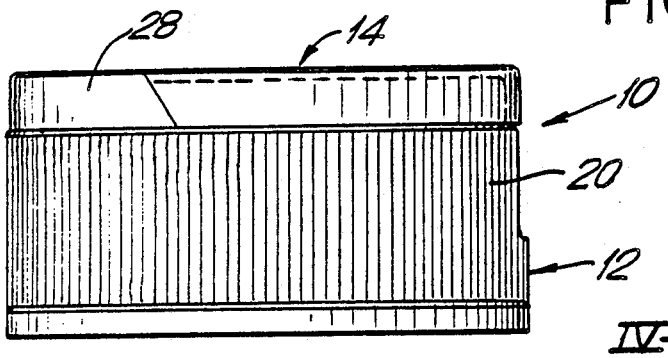
FIG. 2 is a left hand elevational view of the closure.
Figure 3:
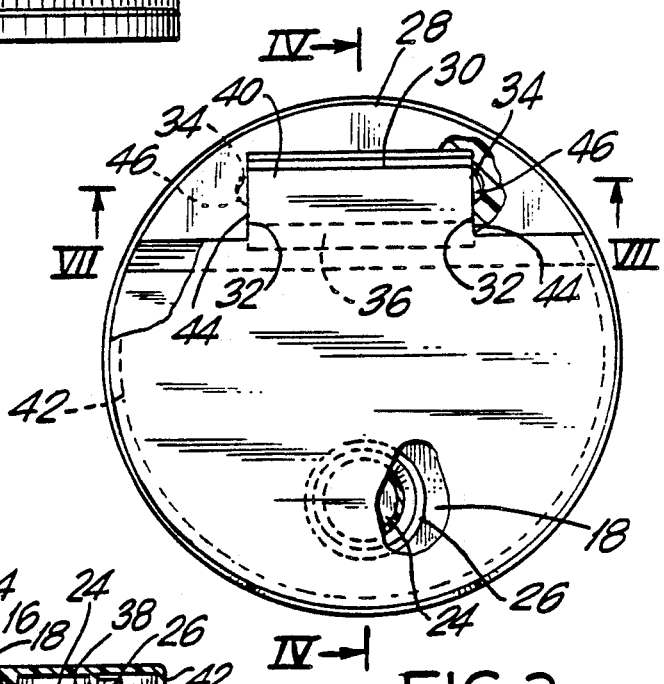
FIG. 3 is a plan view of the closure, with cutaway sections.

Referring to the drawings, the two piece dispensing closure of the present invention is generally indicated by reference numeral 10 and comprises a base which is generally indicated by the reference numeral 12 and a lid which is generally indicated by the reference numeral 14. The base 12 includes a circular cover portion 16 which has a top surface 18 and an annular skirt, or side wall, 20 which is provided with internal threads 22 to enable the cap to be threaded onto the threaded neck of a container.

Other means of affixing the closure to a container may be employed. Such means are well known to those skilled in the art. The cover portion 16 of the base 12 has dispensing orifice 24 having an upstanding annular rim 26.

The cover portion 16 has an elevated rear land section 28 extending upwardly on the side of the cover portion 16 disposed over the dispensing orifice 24. The land portion 28 has a substantially rectangular pivot recess 30. The pivot recess 30 is defined by a pair of vertical side walls 32, each wall 32 having a circular indent 34, a rear wall 31, and an outwardly sloping front wall 35 forming a portion of a ridge 36. The height of the ridge 36 is slightly less than the height of the elevated rear section 28 in order to accommodate the thickness of the lid, as described in detail below, to provide a uniformly flat upper surface to the closure when the lid is in the closed position.

Figure 4:
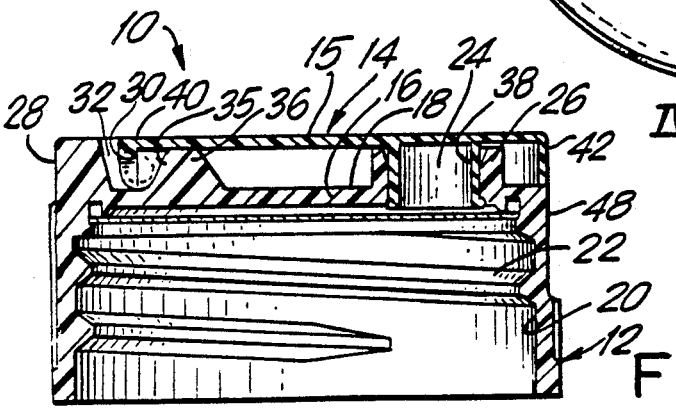
FIG. 4 is a vertical cross-sectional view of the closure taken along line IV—IV of FIG. 3, and looking in the direction of the arrows.
Figure 5:
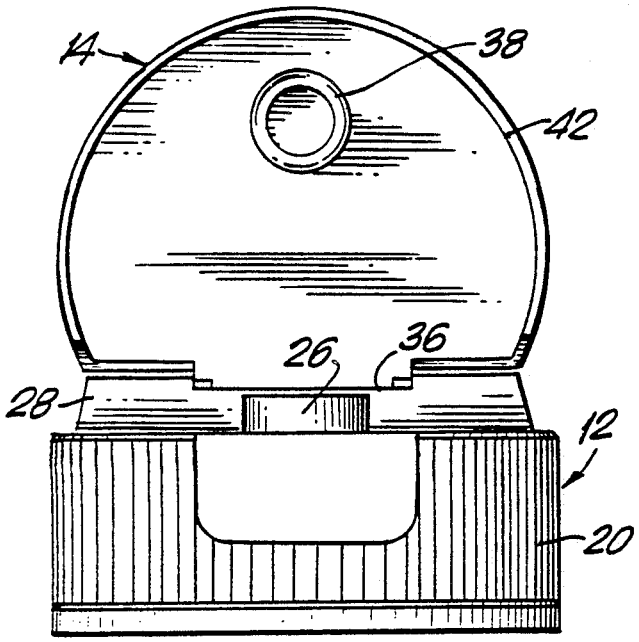
FIG. 5 is a front elevational view of the closure with the lid in the open portion.
Figure 6A:
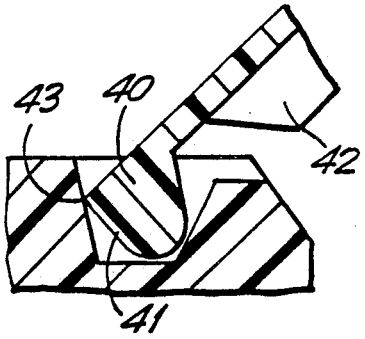
FIG. 6A is an enlarged sectional view of the hinge portion of the closure of FIG. 6.
Figure 6B:
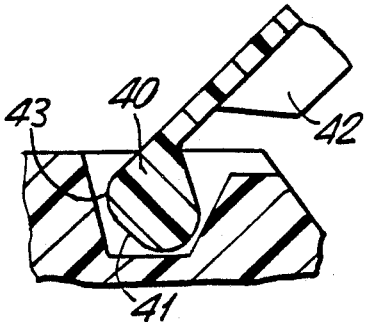
FIG. 6B is an enlarged sectional similar to FIG. 6A, illustrating a different embodiment of the lid.
Figure 6:
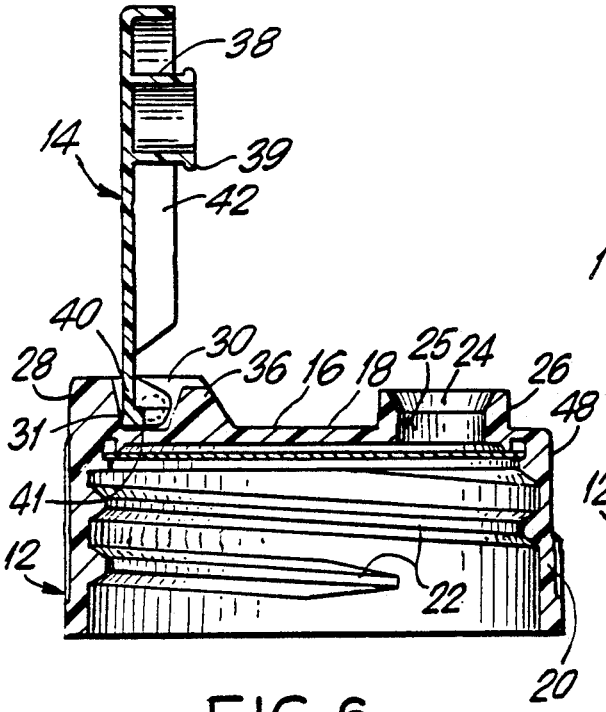
FIG. 6 is a vertical cross-sectional view similar to FIG. 4, and showing the lid in the open position.
Figure 7:
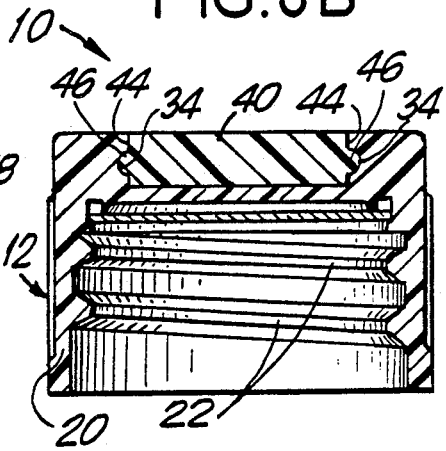
FIG. 7 is a vertical cross-sectional view of the closure taken along the line VII—VII of FIG. 3, and looking in the direction of the arrows.

The lid 14 has a top portion 15 and a skirt portion 42 that is best shown in FIGS. 5 & 6. The skirt portion closes down on the periphery of the base 12 when the lid 14 is in the closed position. The lid 14 is further provided with an annular plug 38 which extends downwardly from the bottom surface of the lid so that it mates with and seals the orifice 24 when the lid is in the closed position as shown in FIG. 4. The end of plug 38 is preferably provided with a bead, or flange, 39 that provides a secure interference fit with the narrowed throat 25 as it is pressed into orifice 24.

At the opposite end of the lid, pivot post 40 is dimensioned so as to be securely received in recess 30, and terminates in an end portion which has side surfaces 44, each surface having a spherical, or rounded, projection 46 which compliments and is snapped into the indents 34 in each of the side walls of the recess 30. The combination of projections 46 and indents 34 forms a hinge connection between the lid 14 and the base 12, and can be reversed so that one or both of the indents are on the pivot post of the lid. This configuration enables the lid 14 to be pivoted from a closed position as shown in FIG. 4, in which the lid is flush with the top surface 18 and the orifice 24 is sealed by the plug 38, to an open position shown in FIG. 6, in which the lid is at least 90° from the position shown in FIG. 4. When the lid 14 is in the closed position as shown in FIG. 4, the top surfaces of the lid 14, including the pivot post 40, and the elevated section 28, all lie in the same horizontal plane. In addition, the configuration also provides the means for securely holding the cap in the base.

When the lid is in closed position, the skirt of the lid continues the line of the side wall of the elevated rear section, or land, to give the appearance of a continuous vertical wall to the closure. The longitudinal and vertical continuity of the closure thus provides an aesthetically pleasing appearance, and to some degree provides a child-resistant safety feature in that the means of gaining entry to the container contents is not immediately apparent. Moreover, the defined structure has the appearance of a one piece cylindrical cap. With the elevated rear section design of the subject closure and a lid covering a limited portion of the surface of the base, a dispensing orifice having an annular rim of substantial height may be used. It is desirable to have the rim defining the pour orifice of substantial height to permit cleaner dispensing that is less prone to dripping. Also, the hinge elements of the closure are well protected within the confines of the recess 30, and the underside of the base is planar.

An important aspect of the structure of the closure of the subject invention resides in the hinge interconnection of the lid 14 and the base 12 at recess 30. It is desirable that the rear wall 31 of the recess 30 be substantially flat so as to provide a surface against which the upper surface of the pivot post 40 may abut in the open position. This abutment, together with the stable frictional interfit of the projections and indents of the hinge, provides a rigid mounting that is substantially aided in retaining its lateral stability due to inability of the side walls of the recess to move away from the mating side walls of the pivot post. This interfit stability is far superior to the relatively unstable interfit between the posts and lid of the prior art in which the open lid can easily be separated from the base.

In a preferred embodiment of the invention mostly clearly shown in the detail of FIG. 6A, the lower terminus of pivot post 40 is generally circular in cross section, with a tangential surface intersecting the upper surface of the pivot at essentially a right angle along edge 43. As the lid is rotated from the closed position, edge 43 of the pivot post 40 contacts the rear wall 31 in an interference fit and then again freely rotates to the fully open position. This interference fit prevents the open lid from closing unless a slight finger pressure is applied. This feature is most desirable when dispensing products from the container with an accompanying shaking motion, which would otherwise tend to move the lid to a closed position. If this occurred during dispensing so as to interfere with the flow path of the product, the undesired consequences are obvious—the product would likely be directed to the user rather than the zone of desired impingement. This means for retaining the lid in the open position also eliminates the potential for splashing which can occur with the spring action "living hinge" of the prior one-piece closures which snap to a closed position. This interference fit is thus accomplished in general by employing an eccentric-concentric design for the rear wall of the recess and pivot post end.

Also as best illustrated in FIG. 6A, the rear wall 31 is inclined from the vertical toward the rear of the base to permit the cap to be opened more than 90° from the closed position. As will be apparent to those skilled in the art the extent of the incline of the rear wall 31 can be from a few degrees up to 45°, depending upon the geometry of the recess, the relative position of the pivot post in the recess, and the maximum angle desired between the lid and the upper surface of the base. In general, it is desirable from the stand point of utility, as well as ease of molding of the base part, that the rear wall 31 make an angle of at least 90° with the base, and most preferably, an angle of from 100° to 120° with the base.

FIG. 6B illustrates another modification of the pivot post in which the rear edge 43 of the lid is rounded, so that there is no interference fit with the rear wall 31 as the lid is raised and lowered. In the configuration of FIG. 6B, the lid is maintained in the open position by virtue of the frictional fit of the ends of the pivot post in the recess.

As will also be appreciated by one skilled in the art the configurations of the recess and pivot post can be modified in various ways to produce the functionally equivalent relationship with the base of the closure. Thus, the pivot post can take the configuration which more nearly resembles a conventional ball joint and the recess likewise modified to the shape of a socket adapted to receive the ball. Other configurations known in the art can be adapted to configure the downwardly depending extension 40 from the rear of the generally circular front section 15 of the lid 14 to mate with the pivot recess 30 in a hinge relationship which has a center of rotation located within the recess.

As will be apparent from the drawings, the axis of rotation of the lid is along a chord, or line, which is perpendicular to the diameter passing through the center of the dispensing orifice. Further, the axis of the recess is displaced on the opposite side of a diameter drawn between the recess and the dispensing orifice. In a preferred embodiment, the length of the recess along the axis of rotation is approximately one-third to one-half the diameter of the closure and it is located at a distance of approximately two-thirds to three-quarters of the diameter from the front skirt or wall of the closure nearest the dispensing orifice.

The configuration of the abutting wall is not critical, and as shown in FIG. 6A, is inclined from the vertical toward the rear, which provides an aesthetically pleasing appearance and facilities removal of the base from the mold.

In addition, the base skirt 20 is provided with knurling to facilitate removal, and the upper surfaces of the base and lid can be embossed during molding with decorative designs, the brand name of the product and instructions for use.

Although the closure is illustrated with internal threads, other means such as bayonet lugs and channels, or a snap-fit bead and recess, can be employed to secure the closure to the container.

The configuration of the closure with the elevated rear land with the pivot recess disposed therein permits an inner safety seal to be installed on the container in contact with the underside of the base. Typically, the circular foil and polyethylene seal is placed inside the closure base, which is then screwed onto the container and then treated ultrasonically to melt and fuse the seal to the upper rim of the container. In closures wherein the hinge structure extends beneath the underside of the cover portion, the placement of an inner seal on the container is foreclosed. Moreover, disposing the hinge structure of the closure out of contact with the container contents avoids potential product contamination.

Referring particularly to FIGS. 1 and 4, the front of the annular skirt 20 is provided with a recess 48 at the juncture of the base skirt 20, and the upper surface 16.

The downwardly extending lid skirt 42 overhangs the annular side wall 20 above the recess 48, as shown in FIG. 4, to facilitate raising of the lid 14 by the user's finger or fingernail.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. In a dispensing closure for a container, the closure comprising (A) a generally circular base having an upper surface with a front section, a dispensing orifice in the front section of the upper surface and an annular skirt depending downwardly from the upper surface and adapted to engage and secure the base to the container, and (B) a separate lid adapted to be pivotally assembled to the base and having a plug on its underside for sealing the dispensing orifice, the improvement which comprises: an elevated rear land disposed above and extending across the upper surface of the base opposite the dispensing orifice and joined to the front section of the base by an abutting wall transecting the upper surface of the base, a pivot recess defining an opening in the surface of the elevated rear land and disposed within the elevated rear land which is adapted to pivotally receive the lid, and said lid having a generally circular front section and a rearwardly extending, downwardly depending pivot post adapted to frictionally engage the pivot recess in the elevated rear land.

2. The dispensing closure of claim 1 where the lid further comprises a downwardly depending skirt which extends from proximate the abutting wall of the base when the lid is closed and enclosures the area under the front section of the closed lid.

3. The dispensing closure of claim 1 where the abutting wall lies on the opposite side of a diameter of the circular base from the dispensing orifice.

4. The dispensing closure of claim 3 where the base has a front edge and the abutting wall is approximately three-quarters of the diameter from the front edge of the base.

5. The dispensing closure of claim 1 where the pivot recess is centered about a diameter of the closure passing through the dispensing orifice.

6. The dispensing orifice of claim 1 where the pivot recess is generally rectilinear and the axis of rotation is parallel to the abutting wall.

7. The dispensing closure of claim 6 where the length of the pivot recess along the axis of rotation is from one-third to one-half of the diameter of the closure.

8. The dispensing closure of claim 6 where the interior surfaces of the pivot recess are generally planar.

9. The dispensing closure of claim 6 where the pivot recess has side walls adapted to securely engage the adjacent surfaces of the pivot post in a frictional fit sufficient to maintain the lid in an open position.

10. The dispensing closure of claim 1 where the pivot post and recess are engaged by means of rounded projections, and where each side wall of the recess has a complementary rounded indentation.

11. The dispensing closure of claim 1 where the pivot post extends below the bottom surface of the front section of the lid.

12. The dispensing closure of claim 6 where the pivot recess has a rear wall at an angle of from 90° to 135° to the upper surface of the base.

13. The dispensing closure of claim 12 where the angle of the rear wall is approximately 110°.

14. The dispensing closure of claim 1 where the underside of the base is substantially planar.

15. The dispensing closure of claim 1 where the upper surface of the rearwardly extending portion of the pivot post lies in the same plane as the front section of the lid.

16. The dispensing closure of claim 1 where the pivot post includes a terminating edge and there is an interference fit between the rear wall of the recess and the terminating edge of the pivot post as the lid is rotated, to thereby restrain the movement of the lid from the open to the closed position during use.

17. The dispensing closure of claim 16 where the terminating edge of the pivot post contacts the rear wall of the pivot recess in an interference fit as the lid is rotated from a closed to open position.

18. The dispensing closure of claim 17 where the interference fit occurs as the lid is rotated from between about 30° to 80° from the closed position.

19. The dispensing closure of claim 2 where the annular skirt of the base has a recess in its outer surface at the front of the base so that the depending skirt of the lid overhangs the base skirt above the recess.

20. The dispensing closure of claim 1 where the lid is molded from a resilient polymeric material.

21. The dispensing closure of claim 1 where the dispensing orifice is circular and the plug is annular.

22. The dispensing closure of claim 21 where the dispensing orifice comprises an upwardly extending annular rim which is engaged by the plug of the closed lid.

23. The dispensing closure of claim 22 where the plug comprises an annular bead adapted to engage an inwardly tapered throat in the dispensing orifice to thereby secure the lid in the closed position.

24. The dispensing closure of claim 1 where the generally circular front section of the lid terminates along a transverse line parallel to and proximate the upper edge of the abutting wall, and the upper surfaces of the closed lid and the elevated rear land of the base are co-planar.

25. A two piece dispensing closure for a container comprising:

(a) a cap having a circular top wall which has a flat forward top surface, an annular side wall which extends downwardly from said top wall adapted to engage the container, and a dispensing orifice in said forward top surface, (b) a transverse abutting wall which extends upwardly from the top surface along the top surface from one side edge to the other side edge of the cap to an elevated rear surface of said top wall, said elevated rear surface having a transverse pivot recess defining an opening in the rear surface and disposed within the cap, the axis of said pivot recess being parallel to said transverse abutting wall, and said pivot recess having a pair of oppositely facing vertical side surfaces and a generally flat rear wall, (c) a generally planar lid which is provided with means for closing said orifice at a forward end of said lid, and a rearwardly extending pivot post which is adapted to be received within the pivot recess, the pivot post having opposite vertical side surfaces which abut the side surfaces of said recess, and (d) one of each of said abutting side surfaces of the pivot post and the pivot recess having a projection and the other of each of said abutting side surfaces having an indentation which is complementary to said projection to enable said lid to be pivoted from a closed position in which the lid is flush with the elevated rear surface and the dispensing orifice is closed by the lid, to an open position in which the lid is displaced at least 90° from closed position.

26. The dispensing closure of claim 25 where the lid further comprises a downwardly depending skirt which extends from proximate the abutting wall of the cap when the lid is closed and encloses an area under a front section of the closed lid.

27. The dispensing closure of claim 26 where the annular side wall of the cap has a recess in its outer surface at a front portion of the cap so that the depending skirt of the lid overhangs the cap side wall above the recess.

28. The dispensing closure of claim 25 where the abutting wall lies on the opposite side of a diameter of the circular cap from the dispensing orifice.

29. The dispensing closure of claim 28 where the cap has a front edge and the abutting wall is approximately three-quarters of the diameter from the front edge of the cap.

30. The dispensing closure of claim 25 where the pivot post includes a terminating edge which contacts the rear wall of the pivot recess in an interference fit as the lid is rotated from a closed to open position.

31. The dispensing closure of claim 25 where the rear wall of the recess is at an angle of at least 90° to the top wall.

32. In a two piece dispensing closure for a container, the closure comprising a lid, said lid having a plug on its underside for sealing a dispensing orifice, and a base member having a top surface portion and a skirt depending downwardly from the top surface, said top surface portion having a dispensing orifice extending above the top surface portion, the improvement comprising an elevated land contiguous to the top surface portion and spaced from the dispensing orifice, said elevated land having a recess spaced from its periphery bordering the skirt of the base for pivotally affixing the lid, said recess being disposed so as to align the plug with the dispensing orifice and thereby allow mating of the plug and orifice.

33. In a two piece dispensing closure for a container, the closure comprising (A) a generally circular base having an upper surface with a dispensing orifice and an annular skirt depending downwardly from the upper surface and adapted to engage and secure the base to the container, and (B) a separate lid adapted to be pivotally assembled to the base and having a plug on its underside for sealing the dispensing orifice, the improvement which comprises: an elevated land spaced from the dispensing orifice, which land extends upwardly from the upper surface of the base, the upper surface of the elevated land having a recess therein for pivotally affixing the lid, the pivot recess comprising two side walls and a rear wall and being adapted to pivotally receive the lid, and said lid having a generally circular section and a downwardly depending pivot post adapted to frictionally engage the recess in the elevated land.

34. The dispensing closure of claim 33 where the elevated land surrounds the pivot recess.

35. The dispensing closure of claim 33 where the pivot recess further comprises a front wall.

36. A two piece dispensing closure for a container comprising:

(a) a base having a flat top wall section, which section has a dispensing orifice disposed therein, an annular side wall adapted to engage the container, and a lid, (b) an elevated land spaced from the dispensing orifice, which land extends upwardly from the top wall section of the base, the upper surface of the elevated land having a recess therein for pivotally affixing the lid, said recess having a pair of oppositely facing vertical side surfaces, a bottom surface and a generally flat rear wall against which the lid can open, (c) said lid being generally planar and provided with means for closing the dispensing orifice, and said lid having an extending pivot post which is adapted to be received within the recess, the pivot post having opposite vertical side surfaces which abut the side surfaces of said recess, and (d) one of each of said abutting side surfaces of the pivot post and the recess having a projection and the other of each of said abutting side surfaces having an indentation which is complementary to said projection to enable said lid to be pivoted from a closed position in which the top surface of the lid is coplanar with the upper surface of the elevated land and the dispensing orifice is closed, to an open position in which the lid is displaced at least 90° degrees from said closed position.

37. The dispensing closure of claim 36 where the upper surface of the elevated land is joined to the base by an abutting wall.

38. The dispensing closure of claim 37 where the abutting wall is continuous across the base.

39. The dispensing closure of claim 38 where the abutting wall is continuous across the base and the front wall of the pivot recess is part of the abutting wall.

* * * * *